US008744102B2

(12) United States Patent
Klinkby et al.

(10) Patent No.: US 8,744,102 B2
(45) Date of Patent: Jun. 3, 2014

(54) HEARING AID, AND A METHOD FOR CONTROL OF ADAPTATION RATE IN ANTI-FEEDBACK SYSTEMS FOR HEARING AIDS

(75) Inventors: Kristian Tjalfe Klinkby, Varlose (DK); Peter Magnus Norgaard, Frederiksberg (DK); Helge Pontoppidan Foeh, Stenlose (DK)

(73) Assignee: Widex A/S, Lynge (DK)

( * ) Notice: Subject to any disclaimer, the term of this patent is extended or adjusted under 35 U.S.C. 154(b) by 1584 days.

(21) Appl. No.: 12/241,801

(22) Filed: Sep. 30, 2008

(65) Prior Publication Data

US 2009/0067651 A1 Mar. 12, 2009

Related U.S. Application Data

(63) Continuation-in-part of application No. PCT/EP2007/053175, filed on Apr. 2, 2007.

(30) Foreign Application Priority Data

Apr. 1, 2006 (DK) ..... 200600467

(51) Int. Cl.
*H04R 25/00* (2006.01)

(52) U.S. Cl.
USPC ..... 381/318; 381/312; 381/313

(58) Field of Classification Search
USPC ..... 381/312–331
See application file for complete search history.

(56) References Cited

U.S. PATENT DOCUMENTS

2002/0057814 A1* 5/2002 Kaulberg ..... 381/312

FOREIGN PATENT DOCUMENTS

| | | | | |
|---|---|---|---|---|
| EP | 1471765 | A2 | 10/2004 | |
| JP | 63001296 | A | 1/1988 | |
| JP | 63004795 | A | 1/1988 | |
| JP | 05173592 | A * | 7/1993 | ..... G01L 9/08 |
| WO | 9926453 | A1 | 5/1999 | |
| WO | 0106812 | A1 | 1/2001 | |
| WO | 0225996 | A1 | 3/2002 | |
| WO | 03034784 | A1 | 4/2003 | |
| WO | 2005/020632 | A1 | 3/2005 | |
| WO | 2005091675 | A1 | 9/2005 | |
| WO | 2005096670 | A1 | 10/2005 | |
| WO | 2007113283 | A1 | 10/2007 | |

OTHER PUBLICATIONS

Japanese Office Action for Japanese Application No. 2009502119 dated Sep. 6, 2011 with English Translation.

(Continued)

*Primary Examiner* — Matthew Eason
(74) *Attorney, Agent, or Firm* — Sughrue Mion, PLLC

(57) ABSTRACT

A hearing aid comprises at least one microphone (M) for converting input sound into an input signal, a subtraction node for subtracting a feedback cancellation signal from the input signal thereby generating a processor input signal, a hearing aid processor (G) for producing a processor output signal by applying an amplification gain to the processor input signal, a receiver (R) for converting the processor output signal into output sound, an adaptive feedback cancellation filter for adaptively deriving the feedback cancellation signal from the processor output signal by applying filter coefficients, calculation means for calculating the autocorrelation of a reference signal, and an adaptation means for adjusting the filter coefficients with an adaptation rate, wherein the adaptation rate is controlled in dependency of the autocorrelation of the reference signal.

18 Claims, 6 Drawing Sheets

(56) References Cited

OTHER PUBLICATIONS

A. Spriet et al, "Adaptive Feedback Cancellation in Hearing Aids with Linear Prediction of the Desired Signal", IEEE Trans. on Signal Processing, vol. 53, No. 10, Oct. 2005.

S. Haykin, "Adaptive Filter Theory", 3rd Edition, Prentice-Hall, NJ, USA, 1996.

D. T. M. Slock, On the Convergence Behavior of the LMS and the Normalized LMS Algorithms, IEEE Trans. Signal Processing, vol. 41, No. 9, Sep. 1993, pp. 2811-2824.

* cited by examiner

HEARING AID, AND A METHOD FOR CONTROL OF ADAPTATION RATE IN ANTI-FEEDBACK SYSTEMS FOR HEARING AIDS

RELATED APPLICATIONS

The present application is a continuation-in-part of application no. PCT/EP2007053175 filed on Apr. 2, 2007 and published as WO-A1-2007113282, the contents of which are incorporated herein by reference.

The present application is based on and claims priority from PA200600467 filed on Apr. 1, 2006 in Denmark, the contents of which are incorporated herein by reference.

BACKGROUND OF THE INVENTION

1. Field of the Invention

The present invention relates to hearing aids. The invention, more particularly relates to hearing aids that rely on adaptive feedback cancellation in order to reduce the problems caused by acoustic and mechanical feedback. The invention further relates to methods for control of the adaptation rate in feedback cancelling systems and hearing aids and to hearing aids and systems that incorporate such methods.

2. Description of the Related Art

Acoustic and mechanical feedback from a receiver to one or more microphones will limit the maximum amplification that can be applied in a hearing aid. Due to the feedback, the amplification in the hearing aid can cause resonances, which shape the spectrum of the output of the hearing aid in undesired ways and even worse, it can cause the hearing aid to become unstable, resulting in whistling or howling. The hearing aid usually employs compression to compensate hearing loss; that is, the amplification gain is reduced with increasing sound pressures. Moreover, an automatic gain control is commonly used on the output to limit the output level, thereby avoiding clipping of the signal. In case of instability, these compression effects will eventually make the system marginally stable, thus producing a howl or whistle of nearly constant sound level.

Feedback cancellation is often used in hearing aids to compensate the acoustic and mechanical feedback. The acoustic feedback path can change dramatically over time as a consequence of, for example, amount of earwax, the user wearing a hat or holding a telephone to the ear or the user chewing or yawning. For this reason it is customary to apply an adaptation mechanism on the feedback cancellation to account for the time-variations.

An adaptive feedback cancellation filter can be implemented in a hearing aid in several different ways. For example, it can be IIR, FIR or a combination of the two. It can be composed of a combination of a fixed filter and an adaptive filter. The adaptation mechanism can be implemented in several different ways, for example algorithms based on Least Mean Squares (LMS) or Recursive Least Squares (RLS).

In A. Spriet, I. Proudler, M. Moonen, J. Wouters: "*Adaptive Feedback Cancellation in Hearing Aids With Linear Prediction of the Desired Signal*", IEEE Trans. On Signal Processing, Vol. 53, No. 10, October 2005 it is described that the accuracy of the estimated feedback cancelling filter is degraded when the incoming signal is spectrally coloured. This is also mentioned in patent application WO 01/06812, "Feedback Cancellation with Low Frequency Input". This patent describes a scheme in which an adaptive resonator filter is used for detecting if a dominating tone is present in the signal, in which case the adaptation rate is significantly increased. This allows for a rapid and efficient cancellation of feedback howl. The drawback is that if the tone is not due to feedback but is present in the environment, the adaptive feedback cancelling may react strongly on this signal, with the risk of noticeable audible artefacts.

In Moonen et al. and WO 01/06812 it is further mentioned that it will lead to bias errors in the model of the acoustic feedback if the microphone signal is spectrally coloured.

The patent application WO 99/26453, "Feedback Cancellation Apparatus and Methods" describes a feedback cancellation system in which separate cancellation filters are used for compensating the acoustic feedback to each microphone in a two-microphone hearing aid. In contrast to prior art in the field, this has the advantage that an adaptive directional system for spatial noise filtering is not treated as an integral part of the acoustic feedback path.

The patent application WO 02/25996 describes a scheme for an adaptive feedback cancellation filter as well as a scheme for stabilization of the hearing aid by using a procedure for estimation of the current stability limit.

LMS and other adaptation algorithms are derived and discussed in the book: S. Haykin: *Adaptive Filter Theory,* 3rd Edition, Prentice-Hall, NJ, USA, 1996.

Further details on convergence and behaviour of the LMS and Normalized LMS algorithms are provided in D. T. M Slock: *On the Convergence Behavior of the LMS and the Normalized LMS Algorithms*, IEEE Trans. Signal Processing, Vol. 41, No. 9, September 1993, pp. 2811-2824.

Even though many recommendations has been given in the prior art as to how the adaptation rate in such systems should be decided on, there still exists a need for improvements in this area. In particular, there exists a need for hearing aids in which methods for automatic adjustment of this rate, in dependency of the acoustic environment, have been implemented.

SUMMARY OF THE INVENTION

On the background described herein, it is an object of some embodiments of the present invention to provide a method and a hearing aid of the kind defined, in which the deficiencies of the prior art methods and hearing aids are remedied by automatically adjusting the adaptation rate of feedback cancellation in dependency of the acoustic environment.

Particularly, it is an object of some embodiments of the present invention to provide a method and a hearing aid allowing to implement specific procedures for selecting an appropriate adaptation step size in feedback cancellation.

It is a further object of some embodiments of the present invention to provide a method and a hearing aid allowing to reduce the error in the estimate of the feedback path of the hearing aid.

It is yet a further object of some embodiments of the present invention to provide a method and a hearing aid allowing to cope with the sensitivity of adaptive feedback cancelling systems to tonal input signals.

It is still another object of some embodiments of the present invention provide a method and a hearing aid allowing to cope with the sensitivity of adaptive feedback cancelling systems to tonal input signals by preventing the onset of feedback initiated oscillation.

It is yet another object of some embodiments of the present invention to provide a method and a hearing aid allowing to cope with the impact of the gain size onto the error in the estimate of the feedback path of the hearing aid.

It is further an object of some embodiments of the present invention to provide a method and a hearing aid allowing to cope with the impact of non-continuous sound in the environment of the hearing aid onto the error in the estimate of the feedback path of the hearing aid.

It is further an object of some embodiments of the present invention provide a method and a hearing aid allowing to cope with the impact of the presence of an adaptive microphone array, and hence the total gain of the hearing aid, onto the error in the estimate of the feedback path of the hearing aid.

It is further an object of some embodiments of the present invention to provide a method and a hearing aid allowing to control the step size in the adaptive algorithm of a feedback cancelling system taking multiple aspects of the acoustic environment into account.

According to the invention several suggestions as to how the adaptation rate should be controlled are given. In particular, it is suggested how the adaptation rate may be automatically adjusted in dependency of the acoustic environment.

The invention, in a first aspect, provides a hearing aid comprising at least one microphone for converting input sound into an input signal; a subtraction node for subtracting a feedback cancellation signal from the input signal thereby generating a processor input signal; a hearing aid processor for producing a processor output signal by applying an amplification gain to the processor input signal; a receiver for converting the processor output signal into output sound; an adaptive feedback cancellation filter for adaptively deriving the feedback cancellation signal from the processor output signal by applying filter coefficients; calculation means for calculating an autocorrelation value of a reference signal; and an adaptation means for adjusting the filter coefficients with an adaptation rate, wherein the adaptation rate is set in dependency of the autocorrelation value calculated for the reference signal. This arrangement allows an improved adjustment of the adaptation rate taking the sensitivity of adaptive feedback systems like adaptive feedback cancellation filters to tonal input signals into account.

A method for control of the adaptation rate in a hearing aid comprising: converting input sound into an input signal; subtracting a feedback cancellation signal from the input signal thereby generating a processor input signal; producing a processor output signal by applying an amplification gain to the processor input signal; converting the processor output signal into output sound; adaptively deriving the feedback cancellation signal from the processor output signal by applying filter coefficients; calculating an autocorrelation value of a reference signal; and adjusting the filter coefficients with an adaptation rate, wherein the adaptation rate is set in dependency of the autocorrelation value of the reference signal. This arrangement allows an improved adjustment of the adaptation rate taking the importance of gain size to the error in the filter coefficients and, hence, the error in the estimate of the feedback path of the hearing aid into account.

According to an embodiment the hearing aid comprises detection means for detecting if the input signal represents a sudden increase in sound pressure of the input sound, and wherein the adaptation means is adapted to temporarily suspend the adjustment of the filter coefficients. This arrangement allows an improved adjustment of the adaptation rate taking the importance of non-continuous sound in the environment of the feedback path of the hearing aid into account.

According to another embodiment, there is provided a hearing aid comprising at least two microphones converting the input sound in at least a first and a second spatial input signal providing a directional characteristic, at least two subtraction nodes for subtracting a first feedback cancellation signal from the first input signal and a second feedback cancellation signal from the second input signal thereby generating a resulting directional processor input signal, at least a first and a second adaptive feedback cancellation filter for adaptively deriving the first and second feedback cancellation signals, and wherein said adaptation means is adapted to further control the adaptation rate in dependency of the directional characteristic. This arrangement allows an improved adjustment of the adaptation rate taking the importance of the contribution of a directional microphone system providing momentary gain or attenuation to the overall system gain into account.

The invention, in a third aspect, provides a computer program product comprising program code for performing, when run on a computer, a method for control of the adaptation rate in a hearing aid comprising: converting input sound into an input signal; subtracting a feedback cancellation signal from the input signal thereby generating a processor input signal; producing a processor output signal by applying an amplification gain to the processor input signal; converting the processor output signal into output sound; adaptively deriving the feedback cancellation signal from the processor output signal by applying filter coefficients; calculating an autocorrelation value of a reference signal; and adjusting the filter coefficients with an adaptation rate, wherein the adaptation rate is set in dependency of the autocorrelation value of the reference signal.

The present invention lays out a number of schemes for adaptively setting the adaptation rate in an algorithm used for adjusting the coefficients in a feedback cancelling filter in a hearing aid. The adaptation rate is varied in accordance with the characteristics of the microphone signal(s) and the various internal parameters and signals inside the hearing aid. According to the present invention, specific ways are provided for adjusting the adaptation rate based on observations of the current microphone signal(s), the present state and/or the behaviour of the hearing aid.

Further aspects, embodiments, and specific variations of the invention are defined by the further dependent claims.

BRIEF DESCRIPTION OF THE DRAWINGS

The invention will now be described in greater detail based on non-limiting examples of preferred embodiments and with reference to the appended drawings. On the drawings.

DETAILED DESCRIPTION OF THE INVENTION

Figure 1:
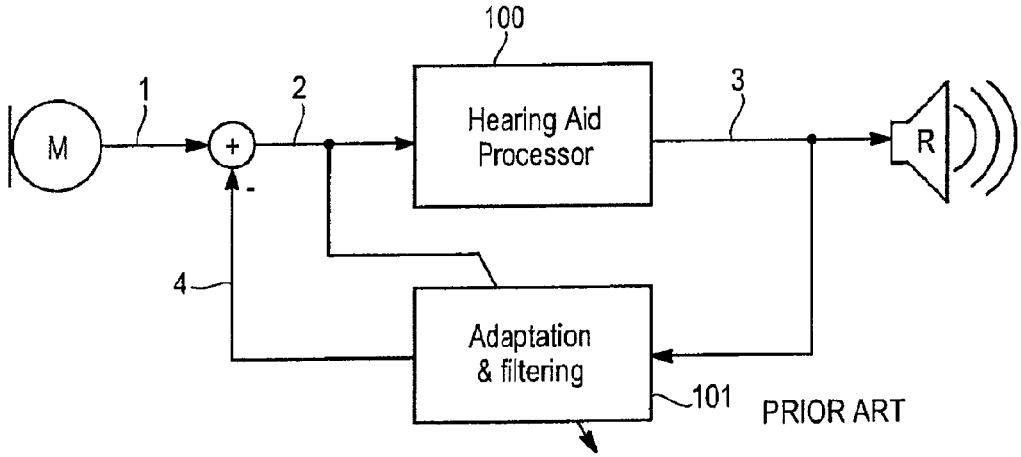
FIG. 1 shows a hearing aid with an adaptive feedback cancellation filter, according to the prior art.
Figure 2:
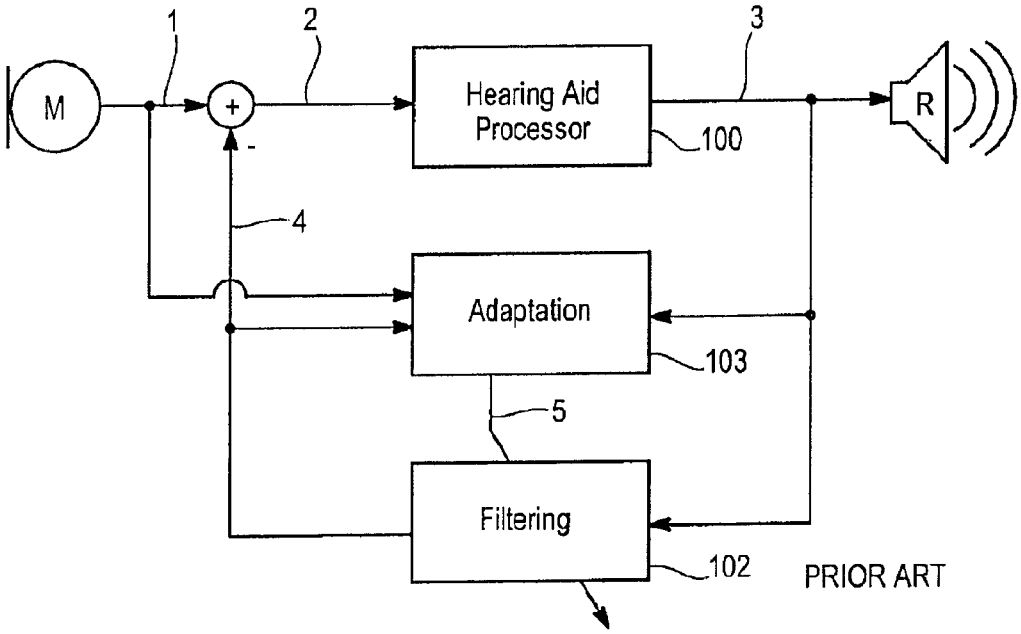
FIG. 2 shows a hearing aid with a feedback adaptation mechanism, according to the prior art.
Figure 3:
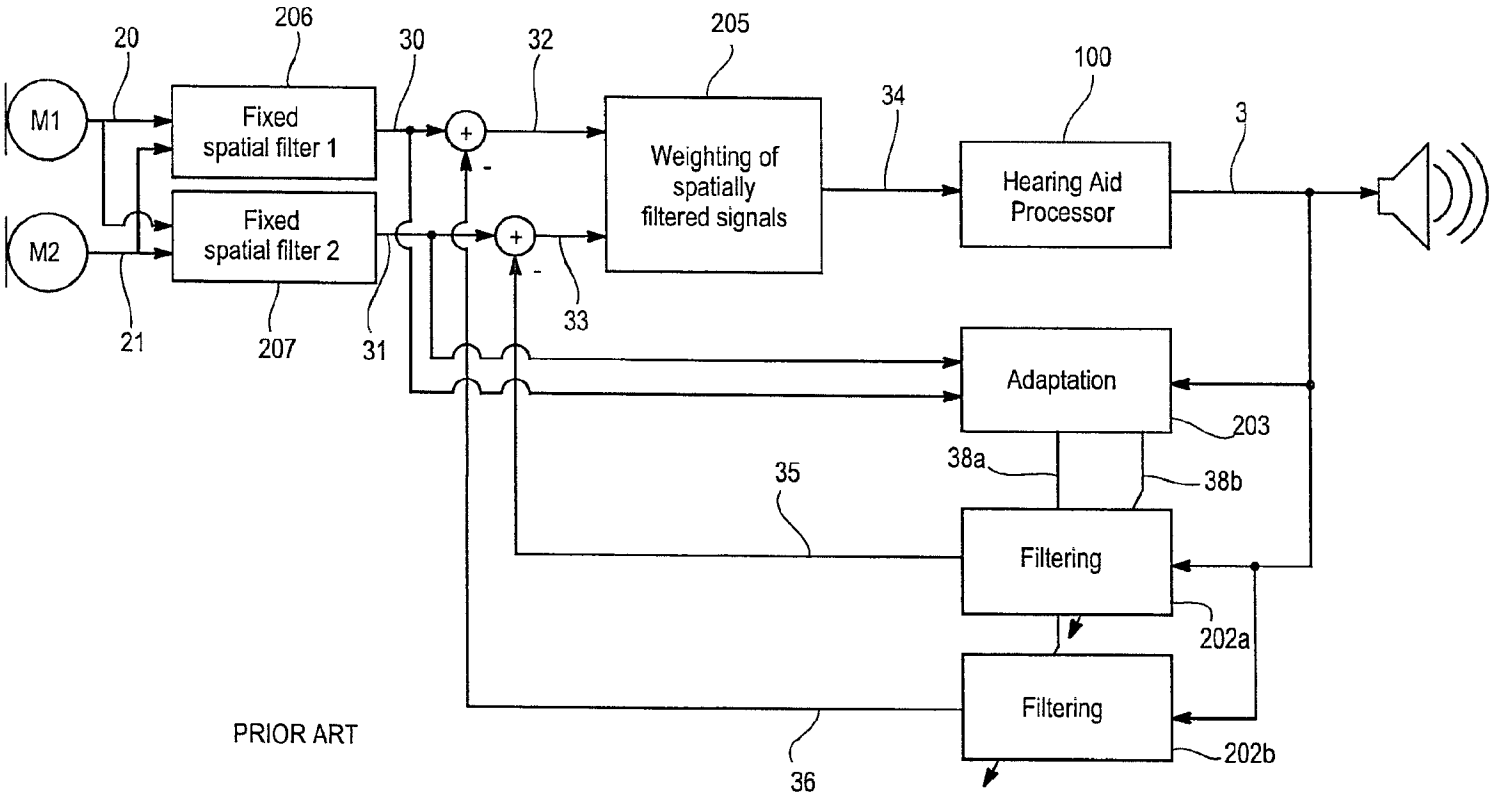
PRIOR ART Fig. 3
FIG. 3 shows a hearing aid with two microphones and two adaptive feedback cancellation filters, according to the prior art.

FIGS. 1-3 show schematic block diagrams of prior art hearing aids implementing some basic feedback cancellation schemes.

In FIG. 1, the microphone signal 1 from the microphone M is compensated by subtraction of the feedback cancelling signal 4. The resulting signal 2 is used as input to the hearing aid processor 100, and it is used as adaptation error in the adaptive feedback cancelling filter 101. The output of the hearing aid processor is transmitted to the receiver R. The hearing aid processor 100 may comprise time-varying and frequency dependent filters to account for the hearing loss, suppression of noise, automatic gain control for handling large signals, and time-delays. The block 101 represents an adaptive feedback cancellation filter and embraces a simultaneous filtering and adaptation of filter coefficients.

The diagram in FIG. 2 shows a system like the one depicted in FIG. 1 except that the adaptation mechanism implemented in block 103 is separated from the filtering function implemented in block 102. The connection 5 symbolizes the filter coefficients. The advantage of this scheme over the one shown in FIG. 1 is that a frequency shaping of the signals 2 and 3 can be made without disturbing the filtering performance.

The diagram in FIG. 3 shows how multiple feedback cancellation filters 202*a*, 202*b* can be used in the case of hearing aids with multiple microphones M1, M2. In this case two sets of filter coefficients 38*a*, 38*b* are passed on from the adaptation block 203. In the example shown here, the two cancellation signals 35, 36 compensate the signals 30, 31, which are created employing two spatial filters of the sound 206, 207, each filter with its own fixed directional pattern (e.g., such than one is omnidirectional and one is bipolar). The compensated signals 32, 33 are subsequently weighted in order to achieve a resulting directional signal. This weighting can be time-varying as this will allow adaptation of the resulting directional pattern to the current sound environment. A band-split into several frequency bands is possible in e.g., 205 as this will make it possible to vary the directional pattern over frequency, thus allowing improved noise reduction. The signal 34 will in this case be a multi-band signal.

Further terms and prerequisites useful for understanding the present invention will be explained when describing particular embodiments of the present invention in the following.

Autocorrelation Dependency

The extent to which a signal, $x_k$, is spectrally coloured is often measured by the autocorrelation of the signal:

$$R_x(\tau) = \sum_{k=\tau}^{N} x_k x_{k-\tau} \quad \text{[Eq. 1]}$$

where $\tau$ is the time lag. For white noise, $R_x(\tau)\approx 0$ for all $\tau\neq 0$. For periodic signals or other signals with a certain amount of predictability, the autocorrelation will be significantly larger than 0 for one or more time lags.

To better allow comparison, the autocorrelation is often normalized with the window size or with the autocorrelation at lag 0:

$$R_x^N(\tau) = \frac{1}{N}\sum_{k=\tau}^{N} x_k x_{k-\tau} \quad \text{[Eq. 2]}$$

or $$r_x(\tau) = \frac{\sum_{k=\tau}^{N} x_k x_{k-\tau}}{\sum_{k=0}^{N} x_k x_k} \quad \text{[Eq. 3]}$$

The autocorrelation coefficients given by the last equation have the property that the values are limited to [−1; 1].

In a practical non-stationary setting, the autocorrelation must be calculated over a sliding window or according to some kind of recursive update. An embodiment of this is to use a sliding average in place of the sum in [Eq. 2]:

$$R_x(\tau,k)=R_x(\tau,k-1)+\alpha\cdot(x_k x_{k-\tau}-R_x(\tau,k-1)) \quad \text{[Eq. 4]}$$

where $\alpha\in]0;1[$ controls the weighting between historic and current signal values.

In a hearing aid context, this update can be quite costly to calculate because many multiplications are required. Particularly if many different lags, $\tau$, are considered or if the calculation is carried out in several frequency bands. Instead, it might be relevant to consider updates that do not approximate the autocorrelation but something, which in a similar sense measures how systematic or predictable a signal is. Two embodiments, both quite simple to compute, as they do not depend on multiplications, are $$R_x(\tau,k)=R_x(\tau,k-1)+\alpha\cdot(z(\tau,k)-R_x(\tau,k-1))$$

$$z(\tau,k)=x_k\,\mathrm{sign}(x_{k-\tau})$$

$$z(\tau,k)=\mathrm{sign}(x_k)\mathrm{sign}(x_{k-\tau}) \quad \text{[Eq. 5]}$$

The co-pending patent application DK 2006 00479 "Method for controlling signal processing in a hearing aid and a hearing aid implementing this method", filed on Apr. 3, 2006, in Denmark, published as WO2007113283, and which is hereby incorporated by reference, describes these along with other signal characterization quantities related to the autocorrelation that can often be used instead of the true autocorrelation.

The autocorrelation can be calculated for a wide-band signal or it can be calculated for a number of band-limited signals. In order to detect if a pure tone is present in the signal, it can be relevant to calculate the autocorrelation coefficients in a number of bands and subsequently look for the maximum of absolute values of the autocorrelation for several time lags and for all frequency bands.

For several reasons, adaptive anti-feedback systems are often based on the adaptive scheme outlined by a variation of the Least Mean Square (LMS) algorithm. As a simple example, we can consider an adaptive FIR filter:

$$\hat{f}_k=w(0)x_k+w(1)x_{k-1}+\ldots+w(M)x_{k-M} \quad \text{[Eq. 6]}$$

Provided that $y_k$ is the observed signal, which contains information about the underlying system we wish to model, the filter coefficients are adjusted according to e.g.,

LMS:

$$w_k(i)=w_{k-1}(i)+\mu x_{k-i}(y_k-\hat{f}_k) \quad \text{[Eq. 7]}$$

Normalized LMS, NLMS:

$$w_k(i) = w_{k-1}(i) + \frac{\mu x_{k-i}}{\sum_{j=k}^{j=k+M} x_k^2}\left(y_k - \hat{f}_k\right) \quad \text{[Eq. 8]}$$

LMS with Variance Normalization:

$$w_k(i) = w_{k-1}(i) + \frac{\mu}{\hat{\sigma}_k^2} x_{k-i}\left(y_k - \hat{f}_k\right) \quad \text{[Eq. 9]}$$

$$\hat{\sigma}_k^2 = \rho\hat{\sigma}_{k-1}^2 + (1-\rho)x_k^2,\ 0 \le \rho < 1$$

Sign-Sign LMS:

$$w_k(i)=w_{k-1}(i)+\mu\,\mathrm{sign}(x_{k-i})\,\mathrm{sign}(y_k-\hat{f}_k) \quad \text{[Eq. 10]}$$

A person skilled in the art however will appreciate that calling the latter an LMS-type algorithm is in a literal sense slightly misleading.

The person skilled in the art will further appreciate that many variations can be made on both filter and algorithm. The adaptive FIR filter can be substituted by a warped delay line, a fixed pre-filter or post-filter can be used, or the filter can be an adaptive IIR-filter. There is a plethora of possible adaptation algorithms in addition to the ones shown.

To accommodate the non-stationary nature of sound environments that a hearing aid user can be exposed to and the highly time-varying signal processing occurring in modern hearing aids, it is beneficial to let the step size, μ, be time-varying. The present invention deals with specific procedures for selecting an appropriate step size or adaptation speed or rate as will be described in detail below.

The invention is particularly useful in relation to the NLMS algorithm as described in Eq. 8, or algorithms exhibiting a similar behaviour, such as the LMS with variance normalization, as described in Eq. 9. The principles are, however, relevant regardless of the implemented adaptation algorithm and may be implemented in various embodiments according to the present invention.

Figure 4:
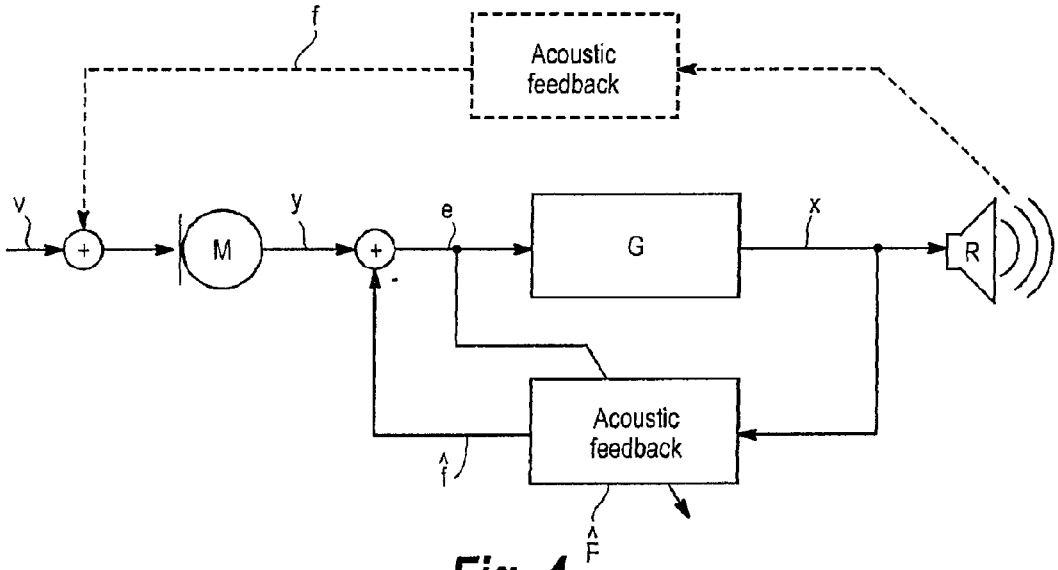
FIG. 4 shows a schematic block diagram of a hearing aid according to an embodiment of the present invention.
Figure 5:
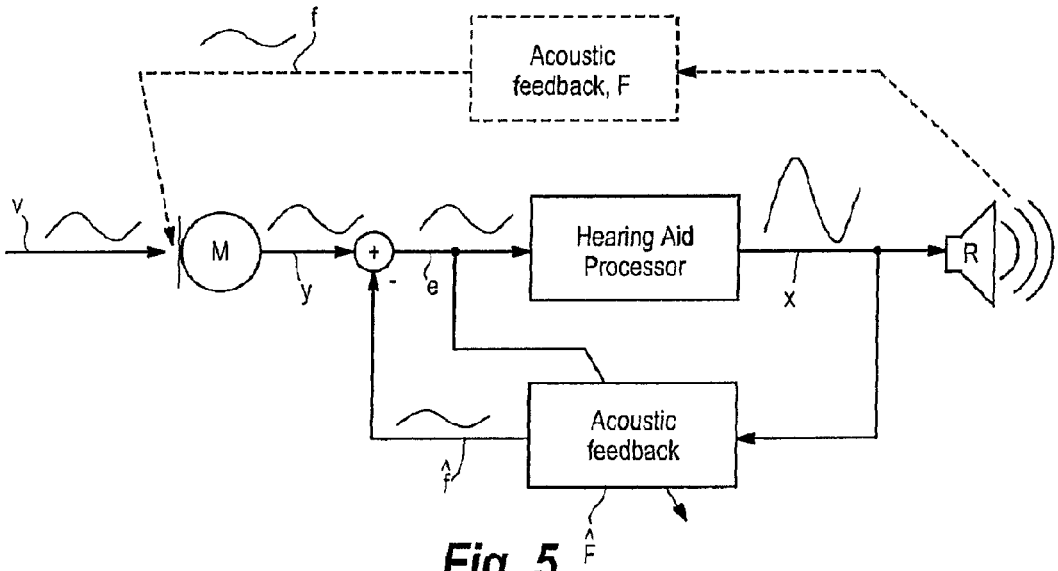
FIG. 5 shows a schematic block diagram of the hearing aid of FIG. 4, with schematic illustrations of the effect of signals with high autocorrelation.

With reference to FIGS. 4 and 5, an embodiment of the present invention will be discussed in connection with the presence of a spectrally coloured microphone signal. The hearing aid basically comprises microphone M, processor G, receiver R, and feedback cancellation filter $\hat{F}$. Considering FIG. 5 but disregarding initially the adaptive feedback cancellation branch expressed by the filter $\hat{F}$, it is assumed that the incoming sound, v, is a pure tone (sinusoid). The microphone output y will then be a sinusoid, and if the hearing aid processing is assumed linear, the processor output x will be a sinusoid. The acoustic feedback signal, f will be a sinusoid. The incoming sound, v, and the acoustic feedback will be blended (summed), which yield another sinusoid (amplitude and phase altered), etc.

The adaptive feedback cancellation filter $\hat{F}$ relies on the processor output x as reference signal and produces output signal $\hat{f}$. The cancellation filter output signal $\hat{f}$ is subtracted from the microphone output y to yield processor input signal e.

If, in this case, one of the filter adaptation algorithms shown in Eqs. 7-10 is used to adjust the coefficients in the feedback cancellation filter $\hat{F}$, the cancellation filter will attempt to cancel y as this signal can be described as x with a simple change in amplitude and phase. The problem is that this is not the goal. The goal is to achieve that $\hat{f}$=f; not to remove tonal components in the environment. This example illustrates that if the external sound, v, is somehow "predictable", one can expect large errors in the coefficients of the adaptive feedback cancellation filter. The present invention suggest to cope with this problem by providing a method according to which the adaptation will be halted if it is detected that an external tone is played as will be described in more detail below.

It has been further observed in relation to the example above that a gain in the hearing aid processor, H, plays an important role for the accuracy of the feedback cancellation. If H represents a small amplification gain, the amplitude of the sinusoid, x, is small compared to the sinusoid, y, because only the amplitude of the feedback signal, f, is affected by the gain; not the incoming sinusoid, v. The reverse is the case when the gain is large. If the cancelling filter adaptation runs, the coefficients in $\hat{F}$ are adjusted to make $\hat{f}$ cancel the signal y. The error in the coefficients will consequently increase with a decreasing gain in the hearing aid processor. This is well in line with the result derived below with reference to Eq. 17.

Generally, it has been observed that the more the signal x resembles a sinusoid with the less accuracy will the cancellation filter model the acoustic feedback (and instead attempt to attenuate the tone). This is a challenge because instability in the hearing aid will typically manifest itself as howling; a periodic signal resembling a tone. According to the present invention, there are at least two approaches provided which, at a first glance, seem to be completely contradictory: If an external tone is played, it is suggested to stop adaptation (μ=0) as otherwise the filter will be misadjusted; if a tone is generated internally due to feedback, it is to adapt fast in order to quickly compensate the tone.

In the patent application WO 01/06812, a procedure is described, where an adaptive resonator filter is used for detecting whether a dominating tone is present. If it is, fast adaptation is used for attenuating the tone. This is an efficient procedure for eliminating feedback howling, but it will obviously produce severe artefacts when tones or whistling sounds are present in the environment.

According to an embodiment of the present invention, another approach to cope with this problem is implemented by reducing the adaptation rate when the sound is spectrally coloured. This will reduce the ability to cancel feedback howling, so, according to a particular embodiment, the reduction of the adaptation rate is used along with a system for stabilizing the closed-loop system by limiting the amplification, thereby stopping the howling.

Generally, modern hearing aids use compression for compensating the hearing-loss. Thus, the amplification in the hearing aid processor is decreased with increasing input sound levels. Without an anti-feedback system, the hearing aid processor will thus in worst case make the closed-loop system marginally stable; i.e., the level of the feedback howling will eventually be constant. To cope with this problem, according to an embodiment of the present invention, if feedback howling is observed then a small decrease in the amplification gain is applied which will stabilize the closed-loop system, resulting in removal of the howling. When the howling is removed, it is again safe to adapt the cancelling filter and eventually the filter will model the acoustic feedback better. This will in turn allow headroom for an increase in the amplification gain.

Further approaches suggesting to stabilize the closed-loop system are disclosed in WO 02/25996, which provides a method for suppressing the time varying acoustic feedback with an adaptive filter, and co-pending patent application, filed on Mar. 31, 2006 with the title "Hearing aid and method of estimating dynamic gain limitation in a hearing aid", PCT/EP2006/061215, published as WO2007112777, which provides an acoustic loop gain estimator for determining a dynamic gain limit, and which is herewith incorporated by reference.

Rather than using a tone detector as described in WO 01/06812, according to an embodiment of the present invention, there is provided a method and a hearing aid using measures of either autocorrelation of the signal or one of the similar quantities as described in the previously mentioned co-pending patent application WO2007113283, "Method for controlling signal processing in a Hearing aid and a Hearing aid implementing this method" to detect whether an external tone is present.

According to further embodiments of the present invention, the mentioned problems with spectral colouring can to some extent be further alleviated by the use of either adaptive notch filters to attenuate tones and/or by adaptive whitening filters to produce a spectral flattening of the signals.

Since it is a complex issue to decide how the adaptation step size should optimally depend on the measure of signal autocorrelation, the present invention provides several methods and hearing aids, which at a first glance might be seen as following to some extent different and contradictory approaches, and which will be described now in more detail.

According to an embodiment of the present invention, the step size of the feedback cancelling filter in a hearing aid is set in dependency of the autocorrelation value of the compensated signal e in FIG. 5. According to an embodiment, the cancelling filter is an FIR filter adjusted according to Eq. 8 or Eq. 9. According to a particular embodiment, an adaptive whitening filter is applied on the reference signal (and a similar filter is applied to the adaptation error). The step size is set according to the following formula resulting in a fast cancellation of tones for which the autocorrelation calculation gives a maximum correlation coefficient value >0.98 so that a fast adaptation rate is applied.

$\mu_{fast}$: A large step-size (fast adaptation rate).

$\mu_{slow}$: A small step-size (slow adaptation rate).

$$r_e(\tau) = \frac{\frac{1}{N}\sum_{k=\tau}^{N} e_k e_{k-\tau}}{\hat{\sigma}_e^2}:$$

Autocorrelation coefficients based on the compensated signal.

$$r_{max} = \max_{\tau}\{|r_e(\tau)|\}:$$

Maximum correlation coefficient.

A procedure for adjustment of the step size is:

If $r_{max}>0.98$ Then $\mu_k=\mu_{fast}$

Else $\mu_k=\mu_{slow}$.

According to another embodiment, the step size is decreased according to a monotonous function with increased autocorrelation of the reference signal. This embodiment allows to reduce the step size with increasing spectral colouring.

According to an embodiment, the cancelling filter is an FIR filter adjusted according to Eq. 8 or Eq. 9. According to a particular embodiment, an adaptive whitening filter is applied on the reference signal (and a similar filter is applied to the adaptation error). The step size is decreased according to the following procedure for increasing maximum correlation coefficients in order to prevent the onset of undesired oscillation due to a distortion of the model of the feedback path modelled by the feedback cancelling filter coefficients. According to particular embodiments, an initiated feedback oscillation will be handled by further measures. The procedure is as follows:

$\mu_1$, $\mu_2$, $\mu_{max}$: step-sizes of increasing magnitude, $0<\mu_1<\mu_2<\mu_{max}<2$ $T_{max}$, $T_1$, $T_2$: Autocorrelation thresholds of decreasing magnitude, $1>T_{max}>T_1>T_2>0$.

$$r_e(\tau) = \frac{\frac{1}{N}\sum_{k=\tau}^{N} e_k e_{k-\tau}}{\hat{\sigma}_e^2}:$$

Autocorrelation coefficients.

$$r_{max} = \max_{\tau}\{|r_e(\tau)|\}:$$

Maximum correlation coefficient.

According to the procedure, the step size is adjusted as follows:

If $r_{max}>T_{max}$ Then $\mu_k=0$

Else If $r_{max}>T_1$ Then $\mu_k=\mu_1$

Else If $r_{max}>T_2$ Then $\mu_k=\mu_2$

Else $\mu_k=\mu_{max}$

The embodiments described above can be varied in numerous ways. As most hearing aids operate in a number of frequency bands, the autocorrelation coefficients are calculated in several bands separately according a particular embodiment. In this way it is often easier to detect if spectral colouring occurs locally. The procedure is as follows:

$$r_e^{(i)}(\tau) = \frac{\frac{1}{N}\sum_{k=\tau}^{N} e_k^{(i)} e_{k-\tau}^{(i)}}{(\hat{\sigma}_e^{(i)})^2}:$$

Autocorrelation coefficients. (i) is an index over bands, $i=\{1, \ldots, B\}$ and redefine $$r_{max}\max_{i}\max_{\tau}\{|r_x^{(i)}(\tau)|\}:$$

Maximum correlation coefficient over bands 1, . . . , B. The coefficient over the bands is then used to adjust the step size as explained above.

Gain Dependency

The description of embodiments of the present invention taking gain dependency into account is based on the derivations in Section 9.4 in S. Haykin: *Adaptive Filter Theory*, 3rd Edition, Prentice-Hall, NJ, USA, 1996. It is advised to consult this book for intermediate results and further description of assumptions.

First the following quantities are introduced:

$\hat{w}_k$: Estimated weight vector at sample k.

$\overline{w}$: Optimum Wiener solution for coefficients in the cancelling filter (i.e., the true coefficients provided that the filter structure is sufficiently flexible to describe the acoustic feedback).

$J_k \equiv E\{e_k^2\}$: The mean squared error at sample k.

$J_{min} \equiv E\{\overline{e}_k^2\}$: The mean squared error evaluated in the Wiener solution. Assuming as above that the Wiener solution for the coefficients corresponds to the true acoustic feedback path then $J_{min}=E\{v_k^2\}$.

$\epsilon_k \equiv \overline{w}-\hat{w}_k$: Coefficient error vector; the error between estimated and "true" coefficients.

$K_k \equiv E\{\epsilon_k \epsilon_k^T\}$: Correlation matrix for the coefficient error vector.

Furthermore, the assumption is made that the reference signal, $x_k$, is white. In most practical sound environments this is not a valid assumption, but it can be achieved through the use of an adaptive whitening filter. According to an embodiment, the output signal x of the hearing aid processor H is input to the adaptive whitening filter (not shown in FIGS. 4 and 5) and the output of the adaptive whitening filter is input to the adaptive cancelling filter.

Consider first the setup shown in FIG. 4 in which the compensated microphone input is multiplied by a simple gain, G, to produce $x_k$. If $x_k$ is assumed white then the environmental signal, $v_k$, is also white. As mentioned; the whitening occurs as a consequence of an adaptive whitening filtering according to a particular embodiment. Further, the following definitions are made:

$R_x=E\{x_k x_k^T\}=\sigma^2 I$: is the correlation matrix for the reference signal.

$R_v=E\{v_k v_k^T\}=\sigma_v^2 I$: is the correlation matrix for the incoming signal. This equals $J_{min}$ under the assumption that the cancelling filter length is sufficient.

According to S. Haykin: *Adaptive Filter Theory,* 3rd Edition, Prentice-Hall, NJ, USA, 1996, the correlation matrix for the coefficient error vector in an LMS-algorithm develops according to $$K_k=(I-\mu R_x)K_{k-1}(I-\mu R_x)+\mu^2 J_{min} R_x \quad \text{[Eq. 11]}$$

Specializing this to white noise reference signals, $R_x=\sigma^2 I$, gives $$\begin{aligned} K_k &= (I-\mu\sigma^2 I)K_{k-1}(I-\mu\sigma^2 I)+\mu^2 J_{min}\sigma^2 I \\ &= (1-\mu\sigma^2)^2 K_{k-1}+\mu^2 J_{min}\sigma^2 I \end{aligned} \quad \text{[Eq. 12]}$$

or in steady state $$\left(1-(1-\mu\sigma^2)^2\right)K_\infty = \mu^2 J_{min}\sigma^2 I \quad \text{[Eq. 13]}$$

$$\Downarrow$$

$$\begin{aligned} K_\infty &= \frac{\mu^2 J_{min}\sigma^2}{2\mu\sigma^2-\mu^2\sigma^4} I \\ &= \frac{J_{min}\mu\sigma^2}{2\sigma^2-\mu\sigma^4} I \end{aligned}$$

To simplify this, the LMS with variance normalization, which has a behaviour similar to that of the NLMS-algorithm, is used according to an embodiment. A more formal treatment relating to NLMS can be found in D. T. M Slock: *On the Convergence Behavior of the LMS and the Normalized LMS Algorithms*, IEEE Trans. Signal Processing, Vol. 41, No. 9, September 1993, pp. 2811-2824. According to the embodiment, the step size is normalized with the exact variance of the reference signal; that is, the step size $$\mu = \frac{\overline{\mu}}{\sigma^2}, \quad \text{[Eq. 14]}$$

is inserted in the above:

$$\begin{aligned} K_\infty &= \frac{J_{min}\overline{\mu}}{2\sigma^2-\overline{\mu}\sigma^2} I \\ &\approx \frac{J_{min}\overline{\mu}}{2\sigma^2} I, \end{aligned} \quad \text{[Eq. 15]}$$

$J_{min}$ is not available, but instead an estimate of it is $$\text{used: } \sigma_e^2 = E\{e_k^2\} = \frac{\sigma^2}{G^2}. \quad \text{[Eq. 16]}$$

Thus, $$K_\infty \approx \frac{\overline{\mu}}{2G^2} I$$

or, if the uncertainty on the individual filter coefficients is considered:

$$\delta w_i = \sqrt{K_\infty^{(i,i)}} \approx \frac{\sqrt{\overline{\mu}/2}}{G}. \quad \text{[Eq. 17]}$$

This result shows that if it is desired to maintain a specific uncertainty on the filter coefficients, the step size should be reduced by $\Delta^2$ every time the gain is reduced by a factor $\Delta$.

In an embodiment, which is more relevant for a modern hearing aid, a bandsplit filter on the signal e in FIG. 4 is used to generate a number of overlapping frequency bands, $\{e_k^{(1)}, e_k^{(2)}, \ldots, e_k^{(B)}\}$. On each of these bands, a separate amplification gain $\{G^{(1)}, G^{(2)}, \ldots, G^{(B)}\}$ is used before the bands are added together to produce the signal $x_k$. In order to ensure a certain maximum uncertainty on the filter coefficients, a safe approach is to scale the step size in accordance with changes in the smallest of the gains $\{G^{(1)}, G^{(2)}, \ldots, G^{(B)}\}$.

Amplification in the Hearing Aid Processor

In the following, embodiments will be described which deal with amplification in the hearing aid processor. The resulting amplification in the hearing aid processor is usually composed of the output of various subsystems, such as a compression unit for compensating the hearing-loss, a temporal noise reduction system for attenuating unwanted noise, automatic gain control and more. Most often, these various systems operate in a number of frequency bands and separate gains are assigned to each band. In some hearing aids, the hearing aid processor is an adaptive wide-band filter and a mechanism is incorporated for adjusting the filter so that the amplitude response varies in accordance with the current sound pressure levels in a number of frequency bands.

According to an embodiment, it is assumed that one of the algorithms NLMS in Eq. 8 or LMS with variance normalization in Eq. 9 is employed for adapting coefficients in the feedback cancelling filter and that the step size is constant. An important lesson learned from Eq. 17 is that if the amplification gain of the hearing aid processor is varied slowly compared to the adaptation rate, the stability margin will be more or less constant. If the amplification gain is increased, the cancelling filter becomes equally more accurate and vice versa. In most hearing aids, the amplification gain is, however, adjusted rapidly in comparison to the possible adaptation rate in the cancelling filter. Thus, if there has been a period of time with a small amplification gain, the accuracy of the cancelling filter is decreased. If suddenly the amplification goes up, the closed-loop system can become unstable.

According to an embodiment, this problem is solved by providing higher accuracy when the hearing aid amplification is small. Thus, when the amplification goes down, the step size, μ, is reduced and vice versa. Following Eq. 17, a nominal step size is selected, which provides the desired accuracy at the maximum amplification gain, and then the step size is reduced proportional to the square of reductions in the amplification gain.

According to another embodiment, the hearing aid processor corresponds to a simple amplification gain. The cancelling filter is an FIR filter adjusted according to Eq. 8 or Eq. 9 and an adaptive whitening filter is applied on the reference signal. According to a particular embodiment, a similar filter is applied to the adaptation error. It is:

$\mu_{max}$: The maximum step-size (fastest adaptation rate).

$G_{max}$: The maximum amplification gain used in the hearing aid processor. The maximum gain can be set according to the hearing-loss or according to an estimate of the stability limit (over which the hearing aid will howl).

$G_k$: Current amplification gain.

With reference to Eq. 17, the step-size at sample number k is calculated as $$\mu_k = \left(\frac{G_k}{G_{max}}\right)^2 \mu_{max} \qquad \text{[Eq. 18]}$$

This step size is then used in a method or hearing aid providing a wide band solution.

According to an embodiment providing a multi-band solution, in a multi-band hearing aid the signal is split into a number of frequency bands and an amplification gain is applied to each band before summing the bands. A conservative step-size control for this application is given below.

$G_{max,i}$: The maximum amplification gain used in the hearing aid processor for band i. The maximum can be set according to the hearing-loss or according to an estimate of the stability limit (over which the hearing aid will howl).

$G_{i,k}$: Current amplification gain used in band i.

With reference to Eq. 17 and assuming we are operating with B frequency bands, the step-size at sample number k is calculated as $$\mu_k = \left(\mathrm{Min}\left\{\frac{G_{1,k}}{G_{max,1}}, \frac{G_{2,k}}{G_{max,2}}, \ldots, \frac{G_{B,k}}{G_{max,B}}\right\}\right)^2 \mu_{max} \qquad \text{[Eq. 19]}$$

Adaptation Halt

Sudden loud sounds, such as a door slamming or a hammer like sound, impose special risks when the cancelling filter is updated with an NLMS-like algorithm. The hearing aid processor will typically delay the signal, as most often it includes a filter bank, an FFT and/or other types of filters. This means that a sudden loud sound will quickly manifest itself in the adaptation error (e) in FIG. 5, but not until later on the reference for the cancellation filter (x). Therefore, the NLMS update as described in Eq. 8 will take very large adaptation steps right after the loud sound occurs because the denominator in Eq. 8 is small and the error signal is large. Moreover, it is adaptation steps, which are not governed by discrepancies between cancellation filter and acoustic feedback path.

Figure 6:
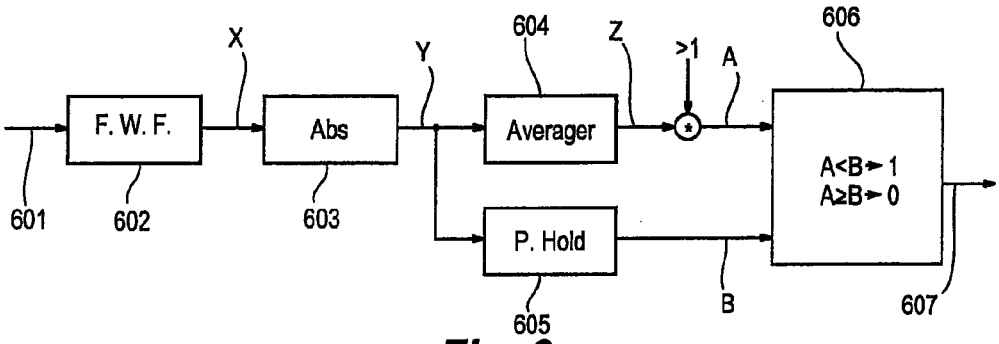
FIG. 6 shows a schematic block diagram of a hearing aid according to an embodiment of the present invention with means for detecting a sudden sound.

According to the invention, methods and hearing aids are provided to detect if a sudden increase in sound pressure occurs and temporarily suspend the adaptation afterwards. An embodiment of this is depicted in FIG. 6 and will now be described.

The input to the mechanism, which is part of a hearing aid, is for example the microphone signal 601 or an omnidirectional signal of the hearing aid. According to a particular embodiment, this signal is filtered. If, e.g., the feedback cancellation filter is implemented according to an embodiment so that it works in the high-frequency range only, it is not of much relevance what happens at lower frequencies. Thus, in order to detect sudden loud sounds with high-frequency components, the frequency weighting filter 602 could be a high-pass filter. The absolute value of the signal X is then taken by Abs-block 603 and this operation is then followed by a sliding averaging in averager 604 or some other type of magnitude calculation. The average of absolute values, Z, reflects the current sound pressure. The time-constant or window size in the average should at least correspond to the delay in the hearing aid processor and the length of the feedback cancelling filter. To detect if a loud sound occurs, the average signal Z is increased by a great amount, which is defined by a constant Threshold to get a signal A, which is then compared in block 606 to the momentary signal magnitude. If the momentary signal magnitude exceeds the signal A, the sound is classified as "a sudden loud sound". In order to suspend the adaptation for a while after this happens, one solution is to use a peak holding block 605 applied on Y, which can store information about the signal maximum for a while after it occurred as signal B. If by the comparison of signals A and B in comparator 606 it is detected that A<B, the adaptation is suspended by sending an adapt_disable signal 607.

Loud sounds (not necessarily sudden) can also cause a nonlinear behavior in one or more components of the hearing aid. The acoustic feedback path as it is seen from the cancelling filter's perspective embraces microphone(s), receiver and input- and output converters. Saturation or overload in one of these units thus corresponds to a non-linearity in the acoustic feedback path. Assuming a linear filter is used for feedback cancellation (such as an FIR filter), the filter is inadequate for modelling the highly nonlinear saturation function, thus leading to errors in the adaptation. Therefore, according to an embodiment, a detector (not shown) for recognition of these circumstances is included in the adaptation mechanism, and adaptation of the cancellation filter is temporarily suspended when the non-linearity occurs. The adaptation may, according to a particular embodiment, be suspended for a short while after one circumstance of that kind has been detected.

Dependency on Directional System—Calculating the Efficiency of a Spatial Filter

Figure 7:
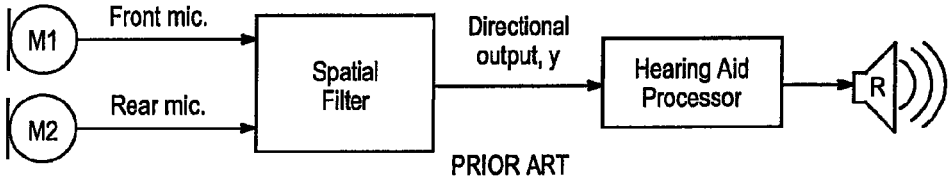
FIG. 7 shows a schematic block diagram of a prior art hearing aid with directional characteristics.

The most advanced hearing aids today are supplied with directional microphones, with two or more omnidirectional microphones, or with a combination of omnidirectional and directional microphones. A directional microphone is a special microphone, which has two inlets and works according to the "delay-and-subtract" principle. Such a microphone will provide a signal, which has a fixed directional pattern. A directional system based on two or more omnidirectional microphones allows for an adaptive directional pattern and can also be extended to work in several frequency bands to enable a frequency dependent directional pattern. See for example patent application WO 01/01731 A1. In any case, spatial filtering is a highly efficient means of increasing the signal-to-noise ratio in many typical listening situations. An example of such a system is shown in FIG. 7.

To determine the efficiency of a directional system at a given point in time it is useful to compare an estimated norm of the signals before and after the directional system. One can use the wide-band signal to get an estimate of the overall efficiency or number of band-pass filtered signals to get an estimate of the efficiency over frequency.

Many norms can be considered and for practical use one will employ an approximation to reflect the value relevant in a window around the current point in time. The general p-norm definition along with some special cases of it is shown in [Eq. 20] and Table 1.

The p-norm of a signal over some window is defined as:

$$N_x = \|x\|_p = \left(\sum_{k=0}^{M} F_k |x_k|^p\right)^{1/p} \quad \text{[Eq. 20]}$$

$\{F_k\}$ represents a window or filter function. Various applicable norms are shown in Table 1 (shown with a rectangular window function of size M):

TABLE 1

| Norm computation | |
|---|---|
| 1-norm | $\|x\|_1 = \|x_1\| + \ldots + \|x_M\|$ |
| Euclidean | $\|x\|_2 = \sqrt{x_1^2 + \ldots + x_M^2}$ |
| General | $\|x\|_p = (\|x_1\|^p + \ldots + \|x_M\|^p)^{1/p}$ for $1 \le p \le \infty$ |
| Infinity | $\|x\|_\infty = \max\{\|x_1\|, \ldots, \|x_M\|\}$ |
| −Infinity | $\|x\|_{-\infty} = \min\{\|x_1\|, \ldots, \|x_M\|\}$ |

A commonly used norm calculation within this category is based on the 1-norm. At sampling instant k, the norm is calculated by the recursive update with exponential forgetting:

$$N_x(k) = \phi|x_k| + (1-\phi)\cdot N_x(k-1) \quad \text{[Eq. 21]}$$

where $\phi$ is a constant, $\phi \in ]0;1]$ (by this update the norm is also normalized to make it independent of window length).

If $N_x$ is the norm of an input signal, x, and $N_y$ is the norm of an output signal, y, then the efficiency of the directional system in the frequency band to which x and y belongs can be calculated as $$G = \frac{N_y}{N_x} \quad \text{[Eq. 22]}$$

If G is near 0, the directional system is highly efficient and is most likely removing a significant amount of noise or irrelevant signal components.

Interaction with Multi-Microphone or Directional Microphone Systems

A directional system for spatially filtering of the sound can be considered as a gain applied to the sound. Depending on the directional pattern selected and the location of the individual sound sources, this "gain" will take different values. Under fortunate circumstances a directional system can reduce the feedback problems, but generally one will not have exact knowledge of the sound source locations. When considering the directional system as a gain, it has been observed that in multi-microphone implementations like those depicted in FIG. 10 and FIG. 8, the formula Eq. 17 plays a role for the accuracy of the feedback cancelling filter.

The overall change of amplification gain due to the directional system can be calculated according to Eq. 21 and Eq. 22.

According to an embodiment, Eq. 17 is used to govern the step size control. An implementation according to this embodiment will be described in the following with reference to FIG. 8.

Figure 8:
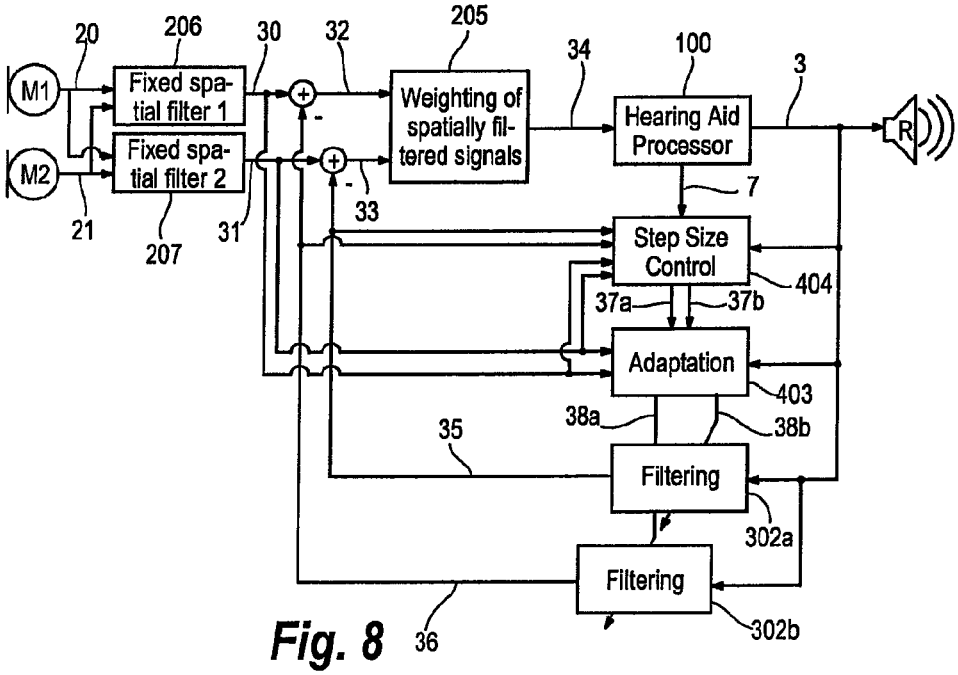
FIG. 8 shows a hearing aid with an adaptive feedback cancelling filter and with directional characteristic, according to an embodiment of the invention.

FIG. 8 shows a hearing aid with directional characteristics. The cancelling filters are FIR filters adjusted according to Eq. 8 or Eq. 9 and an adaptive whitening filter is applied on the reference signal. According to a particular embodiment, a similar filter is applied to the adaptation errors. The following definitions are made:

$N_{1,k}$: The norm of the first spatial signal 32. The norm is estimated according to Eq. 21.

$N_{2,k}$: The norm of the second spatial signal 33. The norm is estimated according to Eq. 21.

$P_k$: The norm of the resulting directional signal 34. The norm is estimated according to Eq. 21.

$$G_{1,k} = \frac{P_k}{N_{1,k}}:$$

Reduction of the first spatial signal 32 occurring in the directional weighting system 205.

$$G_{2,k} = \frac{P_k}{N_{2,k}}:$$

Reduction of the second spatial signal 33 occurring in the directional weighting system 205.

$\mu_{max}$: The maximum step-size (fastest adaptation rate).

To keep an upper limit on the accuracy of the cancelling filter, according to an embodiment changes of the step size are made by using Eq. 17. For sample k the step sizes used in the two feedback cancelling filters are then calculated as $$\mu_{1,k} = G_{1,k}^2 \mu_{max} \quad \text{[Eq. 23]}$$

$$\mu_{2,k} = G_{2,k}^2 \mu_{max} \quad \text{[Eq. 24]}$$

According to another embodiment, a multi-band directional system is used. If the signals 32 and 33 in FIG. 8 are split into several frequency bands before being weighted together to achieve a further noise reduction compared to what is possible using a weighting of the broad-band signals, the gain reductions defined above must be calculated for each frequency band. A step size parameter can then be calculated for each band. The safest approach is then to take the minimum step size for each of the two branches and use these in the feedback cancelling filters:

$$\mu_{1,k} = \mathrm{Min}\{\mu_{1,k}^{(1)}, \mu_{1,k}^{(2)}, \ldots, \mu_{1,k}^{(B)}\} \quad \text{[Eq. 25]}$$

$$\mu_{2,k} = \mathrm{Min}\{\mu_{2,k}^{(1)}, \mu_{2,k}^{(2)}, \ldots, \mu_{2,k}^{(B)}\} \quad \text{[Eq. 26]}$$

Further Embodiments

FIGS. 8-12 show embodiments of hearing aid configurations including a subsystem for step size (adaptation rate) adjustment depicted as step size control block 104, 304 and 404, which will be described in the following.

Figure 9:
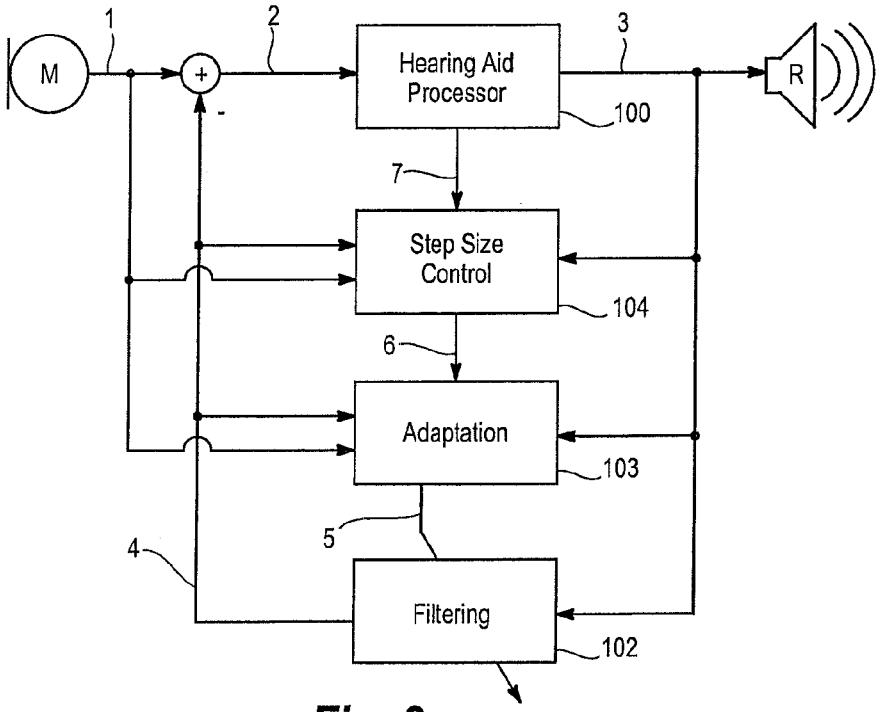
FIG. 9 shows a hearing aid with an adaptive feedback cancelling filter and with a step-size control block, according to an embodiment of the invention.

FIG. 9 shows a hearing aid with one microphone like the one shown in FIG. 2 except that the step size control block 104 has been introduced. The connection 7 symbolizes such information as amplification gains, state of automatic gain controller and noise reduction performance. The output 6 of block 104 is a step size parameter to be used in the adaptation block 103. As it will appear in the following, the step size is set according to the output of the hearing aid processor 3, the microphone signal 1 and the feedback cancelling signal 4.

Figure 10:
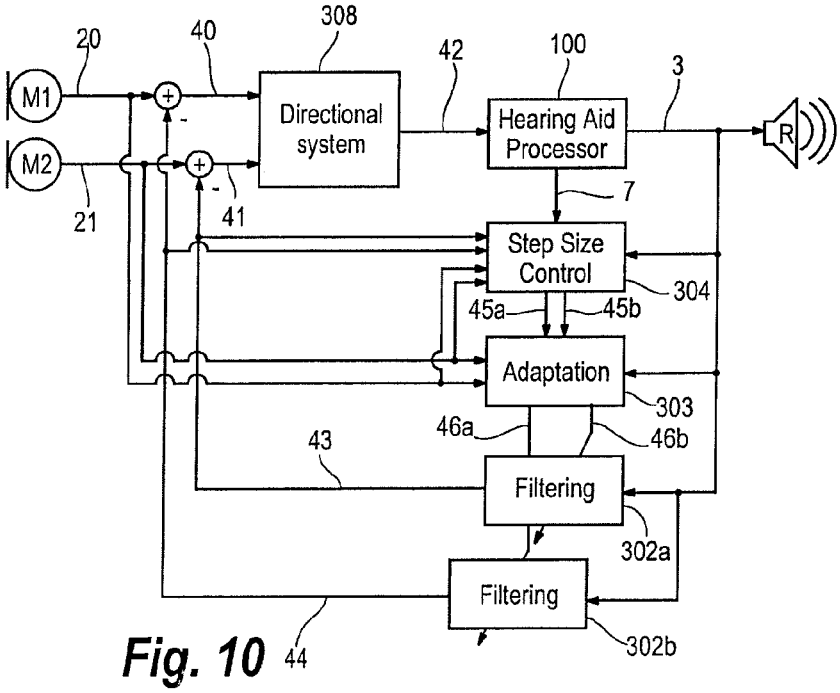
FIG. 10 shows a hearing aid with two microphones and with two adaptive feedback cancelling filters, according to an embodiment of the invention.

FIG. 10 shows a hearing aid with two microphones and a separate feedback cancelling to each microphone signal. The compensated input signals 40, 41 are used as input to a spatial filtering system, which might be adaptive and work in multiple frequency bands. The resulting directional signal(s) 42 is (are) used as input to the hearing aid processor 100. The filters 302*a*, 302*b* produce cancelling signals 43, 44 for each of the microphone signals 20, 21. The adaptation of the cancelling filters takes place in adaptation block 303, and outcome of this block is two sets of filter coefficients 46*a*, 46*b*. The step size control block 304 works on parameters from the hearing aid processor 100, one or both microphone signals, both cancelling filter outputs and the output of the hearing aid processor 100. The step size control block 304 outputs one or two step size parameters 45*a*, 45*b*. If both microphones are omnidirectional, the same step size parameter can be typically be used for adapting both cancelling filters.

Figure 11:
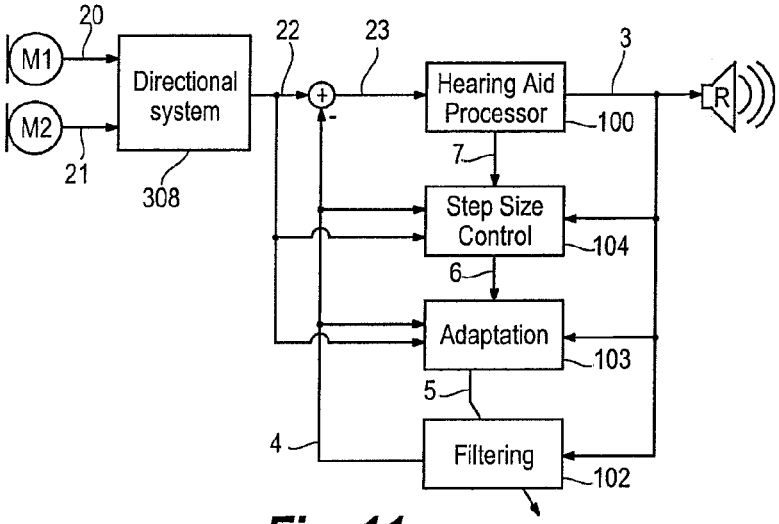
FIG. 11 shows a hearing aid with two microphones and with one adaptive feedback cancelling filter, according to an embodiment of the invention.

FIG. 11 shows a hearing aid with two omnidirectional microphones, a directional system for spatial noise filtering but only one feedback cancelling filter. This configuration is simpler than the one shown in FIG. 10, but the directional system becomes part of the acoustic feedback loop as it is seen from the perspective of the feedback cancelling filter. Thus, time-variations in the directional pattern require adaptation of the feedback cancelling filter coefficients.

Figure 12:
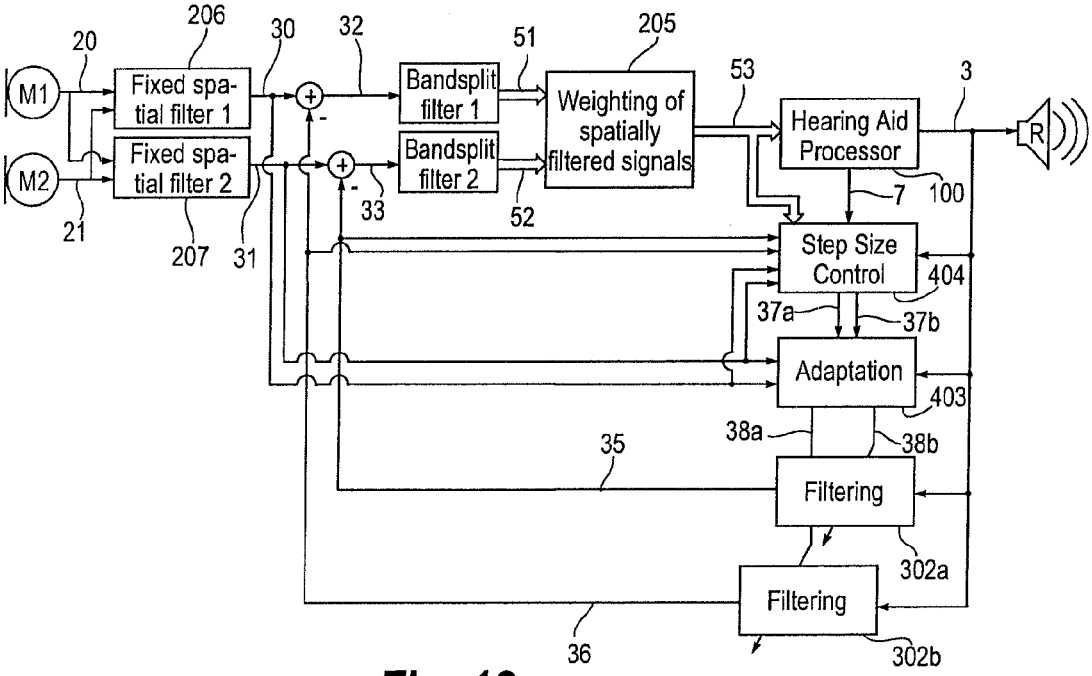
FIG. 12 shows a hearing aid with two microphones and with a step-size control, according to an embodiment of the invention.

FIG. 12 shows a configuration similar to the one depicted in FIG. 3, but with the addition of a step size control Block 404. This block provides two separate step size parameters 37*a*, 37*b* to be used for adaptation in block 403 of the coefficients 38*a*, 38*b* for each of the feedback cancelling filters 302*a*, 302*b*. A consequence of using this concept as opposed to the one depicted in FIG. 10, is a highly different weighting of the adaptation error. Due to this difference, it is often easier to ensure stability of the hearing aid under the user of large amplification gains.

In the following, further embodiments will be described which aim at providing an appropriate adaptation rate adjustment to remedy different adjustment problems.

Anti-Feedback Systems for Hearing Aids

If one of the adaptation algorithms as defined in Eq. 7-Eq. 10 is used in a hearing aid like one of those depicted in FIGS. 1-3 & 8-12, and the sound input represents a typical everyday sound environment, one will never achieve that the cancellation filter is an exact model of the acoustic feedback path. If an LMS-type adaptation algorithm is used with a constant step size, μ, the accuracy of the estimated feedback path will depend on several factors:

1) The magnitude of the adaptation rate
2) The function and amplification in the hearing aid processor block 100.
3) The "condition" of the microphone signal or signals; is the signal spectrally coloured or is it "noise-like"?
4) The performance of the multi-microphone directional system if such a system is integrated in the hearing aid.
5) The acoustic feedback path In order to make an accurate anti-feedback filter, the adaptation step size according to an embodiment is controlled in accordance with the items 2)-5). Further comments on each of the items mentioned will be given in the following along with a suggested adjustment of the step size parameter in each case.

Combining the Individual Effects

Various observations about the signals entering the hearing aid and the state and behaviour of the hearing aid have been discussed above along with suggestions for adjusting the step size parameter accordingly. In the following, further embodiments will be described for how to combine the various effects into a single step size parameter for each feedback cancelling filter.

At first, an embodiment of a hearing aid with directional system and a two-path feedback cancelling filter will be described with reference to FIG. 12 depicting a hearing aid with a two-microphone implementation. According to a particular embodiment, the two feedback cancelling filters 302*a* and 302*b* are FIR-type filters, where the coefficients are adjusted using an adaptation block 403 such as LMS with variance normalization, as defined in Eq. 9, or an NLMS as defined in Eq. 8. The adaptation block 403, according to an embodiment, contains an adaptive whitening filter which is applied on the reference signal 3 and the same filter is used on the adaptation errors, or, according to further embodiments, in a similar manner on signals 30, 31, 32, and 33. According to a particular embodiment, the hearing aid has B frequency bands and each band has a separate amplification gain and a separate directional pattern. The adaptation step size control unit 404 receives information about amplification gains from the hearing aid processor and band-splitted adaptation errors from either signals 51, 52 or, for simplicity, from signal 53. The latter is used for calculating normalized autocorrelation or another type of self-similarity function for each band. It is further defined:

$N_{1,k}^{(i)}$: The norm of the i'th frequency band of the first spatial signal 51.

The norm is estimated according to Eq. 21.

$N_{2,k}^{(i)}$: The norm of the i'th frequency band of the second spatial signal 52.

The norm is estimated according to Eq. 21.

$P_k^{(i)}$: The norm of the i'th frequency band of the resulting directional signal 53. The norm is estimated according to Eq. 21.

$$G_{1,k}^{(i)} = \frac{P_k^{(i)}}{N_{1,k}^{(i)}}:$$

Reduction of the first spatial signal 51 occurring in the i'th frequency band of the directional weighting system 205.

$$G_{2,k}^{(i)} = \frac{P_k^{(i)}}{N_{2,k}^{(i)}}:$$

Reduction of the second spatial signal 52 occurring in the i'th frequency band of the directional weighting system 205.

$\overline{G}_k^{(i)}$: The current amplification gain for band (i) as calculated in the hearing aid processor.

$\overline{G}_{max}^{(i)}$: The maximum amplification gain that can be used in the hearing aid processor. The maximum can be set according to the hearing-loss or according to an estimate of the stability limit (over which the hearing aid will howl).

$$r_e^{(i)}(\tau) = \frac{\frac{1}{N}\sum_{k=\tau}^{N} e_k^{(i)} e_{k-\tau}^{(i)}}{(\hat{\sigma}_e^{(i)})^2} :$$

Autocorrelation coefficients for the i'th band of the feedback compensated signal. $\tau_0<\tau\leq N$. $\tau_0$ is the standard transportation delay from the sound is send to the receiver until it is picked up by the microphone. N is the length of the tapped delay line used in the cancelling filters.

$\mu_{max}$: The maximum step-size (fastest adaptation rate).

For band i, calculate a step size decrement factor due to the amplification gain $$\Delta\bar{\mu}_k^{(i)} = \left(\frac{\bar{G}_k^{(i)}}{\bar{G}_{max}^{(i)}}\right)^2 \quad \text{[Eq. 27]}$$

and for each cancelling branch also a set of decrement factors due to the spatial filtering:

$$\Delta\mu_{1,k}^{(i)}=(G_{1,k}^{(i)})^2 \quad \text{[Eq. 28]}$$

$$\Delta\mu_{2,k}^{(i)}=(G_{2,k}^{(i)})^2 \quad \text{[Eq. 29]}$$

Thus, a large decrement factor is equivalent to a small value $\Delta\mu$.

According to an embodiment, the autocorrelation coefficients in each frequency band are calculated from the feedback compensated inputs to the hearing aid processor. Then, a decrement factor is calculated in accordance with the maximum magnitude of the autocorrelation coefficients for each band (assuming the amplification gain is maximum):

$\Delta\mu_1$, $\Delta\mu_2$: Decrement factors of decreasing magnitude, $0<\Delta\mu_1<\Delta\mu_2<1$ $T_{max}$, $T_1$, $T_2$: Autocorrelation thresholds of decreasing magnitude, $1>T_{max}>T_1>T_2>0$.

$$\text{If } \max_\tau(r_k^{(i)}(\tau)) > T_1 \text{ Then } \Delta\tilde{\mu}_k^{(i)} = \Delta\mu_1$$

$$\text{Else If } \max_\tau(r_k^{(i)}(\tau)) > T_2 \text{ Then } \Delta\tilde{\mu}_k^{(i)} = \Delta\mu_2$$

The various decrement factors can be combined in different ways. According to a preferred embodiment, the step size decrement factors are compared within each band due to amplification gain and efficiency of the directional system, $\Delta\bar{\mu}_k^{(i)}\cdot\Delta\mu_{1,k}^{(i)}$, to the step size decrement factors due to the colouring of the adaptation error:

$$\Delta\mu_{1,k} = \min_i\left(\min\left(\Delta\bar{\mu}_k^{(i)}\cdot\Delta\mu_{1,k}^{(i)}, \sqrt{\Delta\bar{\mu}_k^{(i)}\cdot\Delta\mu_{1,k}^{(i)}}\cdot\Delta\tilde{\mu}_k^{(i)}\right)\right) \quad \text{[Eq. 30]}$$

$$\Delta\mu_{2,k} = \min_i\left(\min\left(\Delta\bar{\mu}_k^{(i)}\cdot\Delta\mu_{2,k}^{(i)}, \sqrt{\Delta\bar{\mu}_k^{(i)}\cdot\Delta\mu_{2,k}^{(i)}}\cdot\Delta\tilde{\mu}_k^{(i)}\right)\right) \quad \text{[Eq. 31]}$$

As described previously, the error in the feedback cancelling filter will (in open-loop and for a fixed step size) be inverse proportional to the gain in the hearing aid processor. This dependency can be expressed by multiplying the decrement factors due to the colouring to the square root of the product of the two other types of decrement factor, as this square root is proportional to the decrement of the maximum amplification gain. Subsequent to these calculations, the largest decrement factor (smallest value) over bands is taken. The resulting step size for each branch is then $$\mu_{1,k}=\Delta\mu_{1,k}\cdot\mu_{max} \quad \text{[Eq. 32]}$$

$$\mu_{2,k}=\Delta\mu_{2,k}\cdot\mu_{max} \quad \text{[Eq. 33]}$$

According to an embodiment following a simpler, but quite conservative strategy, the decrements are multiplied within each band and subsequently take the factor leading to the largest decrement:

$$\Delta\mu_{1,k} = \min_i(\Delta\bar{\mu}_k^{(i)}\cdot\Delta\tilde{\mu}_k^{(i)}\cdot\Delta\mu_{1,k}^{(i)}) \quad \text{[Eq. 34]}$$

$$\Delta\mu_{2,k} = \min_i(\Delta\bar{\mu}_k^{(i)}\cdot\Delta\tilde{\mu}_k^{(i)}\cdot\Delta\mu_{2,k}^{(i)}) \quad \text{[Eq. 35]}$$

According to another embodiment also following a simple strategy, the autocorrelation-based decrements are treated separate from the other two types of decrements (gain-based and spectral colouring based). In this case, the $\Delta\mu_k^{(i)}$ should not be correspond to the maximum gain but rather be appropriate for a typical gain:

$$\Delta\mu_{1,k} = \min_i(\min(\Delta\bar{\mu}_k^{(i)}\cdot\Delta\mu_{1,k}^{(i)}, \Delta\tilde{\mu}_k^{(i)})) \quad \text{[Eq. 36]}$$

$$\Delta\mu_{2,k} = \min_i(\min(\Delta\bar{\mu}_k^{(i)}\cdot\Delta\mu_{2,k}^{(i)}, \Delta\tilde{\mu}_k^{(i)})) \quad \text{[Eq. 37]}$$

According to particular embodiments, the calculated value of the step size parameter is overruled if either a large correlation is detected or a loud sound suddenly occurs. Under these circumstances, the adaptation of the cancelling filter coefficients is suspended. That is, $$\text{If } \max_i\left(\max_\tau(r_k^{(i)}(\tau))\right) > T_{max},$$

or if a sudden loud sound is detected according to the circuit shown in FIG. 6, Then $\mu_{1,k}=\mu_{2,k}=0$.

In the following, measures according to embodiments of the pre-sent invention of how to adjust the adaptation rate of a feedback cancellation filter in a hearing aid in dependency of the acoustic environment of the hearing aid are summarised.

When the amplification gain is increased (decreased) by a factor $\Delta$ compared to a nominal gain, the step size should be increased (decreased) by $\Delta^2$ compared to the nominal step size.

When operating with multiple frequency bands, the lowest amplification gain is decisive; if the lowest gain is increased (decreased) by a factor $\Delta$ compared to a nominal gain, the step size should be increased (decreased) by $\Delta^2$ compared to the nominal step size.

If the autocorrelation is high as measured by e.g., Eq. 2, Eq. 3, Eq. 4, or Eq. 5 the step size is increased substantially.

A monotonic correspondence between the autocorrelation or a similar measure of a signals self-similarity and the step size is implemented such that the step size is reduced for increasing correlation or "self-similarity".

When the autocorrelation or similar measure of a signals self-similarity indicates that a pure tone is present in the signal, the adaptation is deactivated (step size=0).

In a multi-band hearing aid, the autocorrelation or similar measure of a signals self-similarity can be calculated within each band. It is suggested to take the maximum of absolute values of the autocorrelation over bands and let this be decisive for the step size.

If a sudden increase in sound pressure occurs in the incoming signal, the adaptation should be deactivated. This deactivation is maintained for a while after the incident.

In a directional system working on wide-band signals, the efficiency of the system is defined by the ratio between the feedback compensated signal(s) and the directional output signal. If the norm is reduced by a factor $\Delta$, the step size should be decreased by $\Delta^2$ compared to the nominal step size.

For a multi-band directional system the efficiency is calculated within in each band. The step size is reduced according to the largest factor $\Delta_i^2$ calculated over bands.

In the multi-band case, combine amplification gain and efficiency of directional system for each band and then select step size as the maximum reduction of the nominal value.

When operating with a multi-band system: combine "gain control", "correlation control" and "directional filter control" in bands to find a set of equivalent step sizes. Next, take the minimum of these and use this as the resulting step size.

According to further embodiments, these principles may well be applied to hearing aids with more than two microphones.

All appropriate combinations of features described above are to be considered as belonging to the invention, even if they have not been explicitly described in their combination.

According to embodiments of the present invention, hearing aids described herein may be implemented on signal processing devices suitable for the same, such as, e.g., digital signal processors, analogue/digital signal processing systems including field programmable gate arrays (FPGA), standard processors, or application specific signal processors (ASSP or ASIC). Obviously, it is preferred that the whole system is implemented in a single digital component even though some parts could be implemented in other ways—all known to the skilled person.

Hearing aids, methods and devices according to embodiments of the present invention may be implemented in any suitable digital signal processing system. The hearing aids, methods and devices may also be used by, e.g., the audiologist in a fitting session. Methods according to the present invention may also be implemented in a computer program containing executable program code executing methods according to embodiments described herein. If a client-server-environment is used, an embodiment of the present invention comprises a remote server computer that embodies a system according to the present invention and hosts the computer program executing methods according to the present invention. According to another embodiment, a computer program product like a computer readable storage medium, for example, a floppy disk, a memory stick, a CD-ROM, a DVD, a flash memory, or any other suitable storage medium, is provided for storing the computer program according to the present invention.

According to a further embodiment, the program code may be stored in a memory of a digital hearing device or a computer memory and executed by the hearing aid device itself or a processing unit like a CPU thereof or by any other suitable processor or a computer executing a method according to the described embodiments.

Having described and illustrated the principles of the present invention in embodiments thereof, it should be apparent to those skilled in the art that the present invention may be modified in arrangement and detail without departing from such principles. Changes and modifications within the scope of the present invention may be made without departing from the spirit thereof, and the present invention includes all such changes and modifications.

We claim:

1. A hearing aid comprising:

at least one microphone for converting input sound into an input signal;

a subtraction node for subtracting a feedback cancellation signal from the input signal thereby generating a processor input signal;

a hearing aid processor for producing a processor output signal by applying an amplification gain to the processor input signal;

a receiver for converting the processor output signal into output sound;

an adaptive feedback cancellation filter for adaptively deriving the feedback cancellation signal from the processor output signal by applying filter coefficients;

calculation means for calculating an autocorrelation value of a reference signal; and an adaptation means for adjusting the filter coefficients with an adaptation rate, wherein the adaptation rate is set in dependency of the autocorrelation value calculated for the reference signal;

wherein the adaptation means is adapted to decrease the adaptation rate when the autocorrelation value of the reference signal increases, and wherein the processor is adapted to decrease the amplification gain when the autocorrelation value of the reference signal increases.

2. The hearing aid according to claim 1, wherein the calculation means is adapted to calculate the autocorrelation value for a number of frequency bands of the reference signal and to determine the maximum autocorrelation value over all of the bands, and wherein the adaptation means is adapted to control the adaptation rate in dependency of the maximum autocorrelation value.

3. The hearing aid according to claim 1, wherein the reference signal is one of the input signal, the processor input signal and the processor output signal.

4. The hearing aid according to claim 1, wherein said adaptation means is further adapted to set the adaptation rate in dependency of the amplification gain, wherein, if the amplification gain is increased by a factor $\Delta$ compared to a nominal amplification gain, the adaptation means is adapted to increase the adaptation rate by $\Delta^2$ compared to the nominal adaptation rate, and wherein, if the amplification gain is decreased by a factor $\Delta$ compared to a nominal amplification gain, the adaptation means is adapted to decrease the adaptation rate by $\Delta^2$ compared to the nominal adaptation rate.

5. The hearing aid according to claim 4, wherein the input signal is a band split signal divided in a number of frequency bands, wherein the hearing aid processor is adapted to apply a respective amplification gain in each of the frequency bands, and wherein the adaptation means is adapted to identify a lowest one among the respective amplification gains and to adjust the adaptation rate based on the changes on the lowest amplification gain.

6. The hearing aid according to claim 4, comprising: a directional system including at least two microphones converting the input sound in at least a first and a second spatial input signal and means for providing a directional characteristic;

a first subtraction node for subtracting a first feedback cancellation signal from the first spatial input signal to generate a first feedback compensated signal and a second subtraction node for subtracting a second feedback cancellation signal from the second spatial input signal to generate a second feedback compensated signal thereby generating a resulting directional processor input signal;

at least a first and a second adaptive feedback cancellation filter for adaptively deriving the first and second feedback cancellation signals; and wherein said adaptation means is adapted to further control the adaptation rate in dependency of the directional characteristic.

7. The hearing aid according to claim 6, wherein, if the ratio between one of the first or second feedback compensated signals and the directional output signal is reduced by a factor $\Delta$ compared to the nominal ratio, the adaptation means is adapted to decrease the adaptation rate for the respective first or second adaptive feedback cancellation filter by $\Delta^2$ compared to the nominal adaptation rate, or, if the ratio is determined in each of the frequency bands, the adaptation means is adapted to decrease the adaptation rate for the respective first or second adaptive feedback cancellation filter by the largest one of the factors $\Delta_i^2$.

8. The hearing aid according to claim 1, comprising step size control means for calculating a step size parameter based on at least one of amplification gain, state of automatic gain controller and noise reduction performance.

9. A method for control of the adaptation rate in a hearing aid comprising:

converting input sound into an input signal;

subtracting a feedback cancellation signal from the input signal thereby generating a processor input signal;

producing a processor output signal by applying an amplification gain to the processor input signal;

converting the processor output signal into output sound;

adaptively deriving the feedback cancellation signal from the processor output signal by applying filter coefficients;

calculating an autocorrelation value of a reference signal; and adjusting the filter coefficients with an adaptation rate, wherein the adaptation rate is set in dependency of the autocorrelation value of the reference signal;

wherein the adjustment of the filter coefficients is deactivated when the autocorrelation value indicates that a pure tone is present in the input signal.

10. The method according to claim 9, wherein a FIR filter is applied to derive the feedback cancellation signal, at least one whitening filter is applied to filter the reference signal or the adaptation error signal for the FIR filter, and wherein the method further comprises the step of adjusting the adaptation rate from a slow to a fast adaptation rate if the autocorrelation value has exceeded a certain value.

11. The method according to claim 9, wherein the adaptation rate us increased if the autocorrelation value exceeds an autocorrelation threshold.

12. The method according to claim 9, wherein the adaptation rate is further controlled in dependency of the amplification gain, wherein, if the amplification gain is increased by a factor $\Delta$ compared to a nominal amplification gain, the adaptation rate is increased by $\Delta^2$ compared to the nominal adaptation rate, and, wherein, if the amplification gain is decreased by a factor $\Delta$ compared to a nominal amplification gain, the adaptation rate is decreased by $\Delta^2$ compared to the nominal adaptation rate.

13. The method according to claim 12, comprising:

converting the input sound in at least a first and a second spatial input signal providing a directional characteristic;

subtracting a first feedback cancellation signal from the first input signal and a second feedback cancellation signal from the second input signal thereby generating a resulting directional processor input signal; and adaptively deriving the first and second feedback cancellation signals;

wherein the adaptation rate is controlled in dependency of the directional characteristic.

14. The method according to claim 13, wherein the adaptation rate is selected as the maximum reduction of the nominal value by a combination of the changes on the amplification gain and the ratio between one of the first or second feedback compensated signals and the directional output signal for each frequency band.

15. The method according to claim 4, wherein the adaptation rate is selected as the minimum of the adaptation rates calculated based on a combination of the changes on the autocorrelation, the amplification gain and the ratio between one of the first or second feedback compensated signals and the directional output signal for each frequency band.

16. The method according to claim 9, further comprising the steps of:

temporarily suspending the adjustment of the filter coefficients, if it is detected that the input signal represents a sudden increase in sound pressure of the input sound.

17. The method according to claim 16, further comprising the steps of:

storing a maximum of the input signal for a certain length of time if the momentary signal magnitude of the input signal exceeds the average of the input signal magnitude by a threshold; and suspending the adjustment of the filter coefficients as long as the maximum is stored.

18. A computer program product comprising a non-transient computer readable medium carrying thereon program code for performing, when run on a computer, a method for control of the adaptation rate in a hearing aid comprising:

converting input sound into an input signal;

subtracting a feedback cancellation signal from the input signal thereby generating a processor input signal;

producing a processor output signal by applying an amplification gain to the processor input signal;

converting the processor output signal into output sound;

adaptively deriving the feedback cancellation signal from the processor output signal by applying filter coefficients;

calculating an autocorrelation value of a reference signal; and adjusting the filter coefficients with an adaptation rate, wherein the adaptation rate is set in dependency of the autocorrelation value of the reference signal;

wherein the adjustment of the filter coefficients is deactivated when the autocorrelation value indicates that a pure tone is present in the input signal.

* * * * *